US009799186B2

(12) United States Patent
Rennie

(10) Patent No.: US 9,799,186 B2
(45) Date of Patent: Oct. 24, 2017

(54) THERMAL EVENT DETECTION AND NOTIFICATION SYSTEM

(71) Applicant: KIDDE TECHNOLOGIES, INC., Wilson, NC (US)

(72) Inventor: Paul Alan Rennie, Berkshire (GB)

(73) Assignee: KIDDE TECHNOLOGIES, INC., Wilson, NC (US)

( * ) Notice: Subject to any disclaimer, the term of this patent is extended or adjusted under 35 U.S.C. 154(b) by 0 days.

(21) Appl. No.: 14/212,227

(22) Filed: Mar. 14, 2014

(65) Prior Publication Data

US 2014/0266742 A1 Sep. 18, 2014

(30) Foreign Application Priority Data

Mar. 14, 2013 (GB) ..... 1304595.0

(51) Int. Cl.

| | |
|---|---|
| ***G08B 17/00*** | (2006.01) |
| ***G08B 5/36*** | (2006.01) |
| ***G08B 7/06*** | (2006.01) |
| *G08B 25/14* | (2006.01) |
| *A62C 3/08* | (2006.01) |

(52) U.S. Cl.

CPC ..... *G08B 17/00* (2013.01); *G08B 5/36* (2013.01); *G08B 7/064* (2013.01); *G08B 7/066* (2013.01); *A62C 3/08* (2013.01); *G08B 25/14* (2013.01)

(58) Field of Classification Search

CPC ..... G08B 17/00; G08B 7/066; G08B 5/36; G08B 17/10; G08B 7/06; G08B 3/10; G08B 25/14; G08B 19/00; G08B 19/005; A62C 3/08; F21S 8/02; B60R 1/12

USPC ..... 340/500, 540, 584

See application file for complete search history.

(56) References Cited

U.S. PATENT DOCUMENTS

| | | | | |
|---|---|---|---|---|
| 5,467,942 | A | 11/1995 | Abbas et al. | |
| 6,393,343 | B1 | 5/2002 | Frey et al. | |
| 6,809,642 | B1 * | 10/2004 | Brenner | G08B 7/062 340/3.1 |
| 2003/0234725 | A1 * | 12/2003 | Lemelson | G08B 7/066 340/521 |
| 2005/0089081 | A1 | 4/2005 | Dammann | |
| 2005/0146427 | A1 | 7/2005 | Mazzone | |
| 2007/0241925 | A1 | 10/2007 | Sharpe | |
| 2011/0007280 | A1 * | 1/2011 | Patterson | B60Q 3/0256 353/12 |
| 2012/0038479 | A1 * | 2/2012 | Ten Wolde | F21S 8/033 340/540 |

(Continued)

FOREIGN PATENT DOCUMENTS

| | | |
|---|---|---|
| EP | 0452057 | 10/1991 |
| KR | 200442209 | 10/2008 |
| WO | 2005031670 A1 | 4/2005 |

OTHER PUBLICATIONS

Search Report dated Jul. 23, 2013 for GB application serial No. 1304595.0; (5 pgs).

(Continued)

*Primary Examiner* — An T Nguyen
(74) *Attorney, Agent, or Firm* — Cantor Colburn LLP

(57) ABSTRACT

A thermal event detection and notification system detects a thermal event, a control unit receives information from, the information being indicative of the detected thermal event. The control unit determines, based on the information received, a location of said thermal event.

9 Claims, 1 Drawing Sheet

(56) References Cited

U.S. PATENT DOCUMENTS

2014/0132183 A1* 5/2014 Van Herpen ..... G08B 7/066
315/297

OTHER PUBLICATIONS

UK Office Action re Application No. GB1304595.0 dated Jan. 20, 2015, 2 pages.

* cited by examiner

THERMAL EVENT DETECTION AND NOTIFICATION SYSTEM

CROSS REFERENCE TO RELATED APPLICATION

The present application claims the benefit of GB application number 1304595.0 filed Mar. 14, 2013, the content of which is hereby incorporated by reference in its entirety.

FIELD OF TECHNOLOGY

The systems described herein are for detecting and notifying a person of a thermal event, such as a fire. The systems described herein may be used in an environment such as within an aircraft, building, ship, train etc.

BACKGROUND

At present, when a fire is detected in an aircraft, for example, by a passenger seeing or smelling a fire, or smoke, a hand extinguisher is used to suppress the fire. Currently, flight attendants in an aircraft follow guidelines in the event of a fire or overheat situation. Hidden fires may occur in areas that are not visible or relatively inaccessible. In such situations smoke or fumes may be produced in one area but may be seen emanating from an aperture, or gap into the cabin some distance away. The guidelines state that the flight attendants may need to locate hotspots that are indicative of the location of a fire, by feeling along cabin surfaces with the back of the hands. Fire-extinguishing agent is then directed onto the fire via ventilation holes in the panels, if present, or the panels may need to be removed or cut to provide local access.

Distributed temperature sensors, such as fibre optics have also been used to detect fires in aircraft. Such distributed temperatures are capable of providing information on the position of a temperature excursion. US 2005/0089081 A1 describes a method for detecting and signalling the existence of overheating conditions and fires in an aircraft, such as in the event of a rupture or leak of the pipe system that carries the hot bleed air from the aircraft engines to the end user devices such as air conditioning packs. The temperature increase and its spatial location are detected by means of a sensor comprising a fibre optic cable and the corresponding sensor signal is provided to a computer for evaluation. This information can be indicated to the flight crew or maintenance personnel by a corresponding display or read-out from the computer.

U.S. Pat. No. 5,467,942 describes a high accuracy light radar, fibre optic temperature sensing system for use in an aircraft such as a helicopter. An optical sensing system simultaneously obtains absolute temperature measurements from various locations in the aircraft while measuring the position of one or more displaceable elements. A plurality of position values associated with respective positions of the displaceable objects and temperature values associated with the temperatures at the plurality of locations are then outputted to the flight controller which then processes this information and outputs appropriate commands to control the actuators of the aircraft.

SUMMARY

A thermal event detection and notification system described herein comprises a sensing means for detecting a thermal event, and a control unit comprising means for receiving information from the sensing means, the information being indicative of the detected thermal event. The control unit further comprises means for determining, based on the information received, a location of the detected thermal event. The system further comprises means, responsive to information received from said control unit regarding said location, for providing an indication of the location of the detected thermal event, wherein the indicating means is configured to provide the indication of the thermal event location at the thermal event location.

In examples described herein the sensing means may be distributed within an area and may be configured to sense the detected thermal event at a plurality of locations within that area. The means for providing an indication of the location of the detected thermal event may further comprise a plurality of location indicating output means that are distributed at a plurality of locations within the area. The control unit may further comprise means for determining which of the plurality of location indicating output means is or are located closest to the detected thermal event location and may be further configured to use the closest location indicating output means to provide the indication of the location of the detected thermal event.

In examples described herein the sensing means may be distributed within an area and may be configured to sense the detected thermal event at a plurality of locations within that area. The means for providing an indication of the location of the detected thermal event may further comprise a plurality of location indicating output means that are distributed at a plurality of locations within the area. The control unit may further comprise means for determining which of the plurality of location indicating output means is or are located closest to the detected thermal event location and for instructing said location indicating output means that are closest to the thermal event location to not provide the same output as the location indicating output means that are not closest to the detected thermal event, thereby providing the indication of the detected thermal event location, at the location of the detected thermal event. In some examples, the output may comprise no output, i.e. the output means is switched off.

In one example, the area may be the inside of an aircraft. In another example, the area may be the inside of a building or room, ship, train etc.

In an example described herein, the indication of the location may comprise a visual indication that is provided at the location of the detected thermal event. In an example described herein, the means for providing a visual indication of the location may comprise a plurality of lights. In this example, each of the plurality of lights therefore corresponds to the each of the plurality of location indicating output means, the output being light.

In another example described herein, the plurality of lights may be configured, in response to the information received from the control means, to provide a first level of illumination at the thermal event location, and a second level of illumination, different to the first level, at a second location which is different to the thermal event location, thereby providing the visual indication of the thermal event at the location of the detected thermal event.

In another example described herein, the plurality of lights may be configured to be illuminated in a plurality of colours and further configured to be illuminated, in response to the information received from the control unit, with a first colour at the thermal event location, and a second colour, different to the first colour, at a second location which is different to the thermal event location, thereby providing the visual indication of the thermal event at the thermal event location.

In this example, the control unit may be configured to select the colours to be used at the location of the thermal event and at the second location.

In another example described herein, the plurality of lights may be configured, in response to information received from the control means regarding the thermal event location, to flash at a first rate at the thermal event location, and to not flash at this first rate at a second location, the second location being different to the thermal event location.

In another example, the plurality of lights may be configured, in response to the information received from the control means regarding the thermal event location, to flash at a first rate at a second location, that is different to the thermal event location, and to not flash at this first rate at the thermal event location, thereby providing the visual indication of the thermal event at said location.

The control unit may be configured to control the light or lights so that those closest to the location of the detected thermal event, i.e. at the thermal event location, flash at different rates to those provided at the second location, or for the light(s) in one of the locations to flash whilst the light(s) in the other location do not.

In some examples described herein the system may be used in an aircraft and the lights may be the reading lights, call lights, emergency exit floor lights, and/or any other light provided in an aircraft. In some examples, the system may be used in a building and the plurality of lights of the building may be used to provide the indication of the location of the thermal event. The systems may also be used in other environments or areas, such as within a cruise ship, or train, etc and may also be integrated with their existing lighting systems.

In another example, the means for providing an indication of the location of the thermal event may be configured to provide an audible indication at the determined location of the detected thermal event. The plurality of location indicating output means for providing the audible indication may therefore, in this example, comprise a plurality of speakers, with the indication being provided by the speaker or speakers that is or are closest to, i.e. at the location of, the detected thermal event. The output in this example is therefore sound. In an example wherein this system is used in an aircraft or such environment, the system may be integrated with the existing audio system provided therein.

In another example described herein, the means for providing an indication of the determined thermal event location may comprise a plurality of audio visual entertainment systems as the location indicating output means. In this example the output is therefore light and/or sound. These may also be used in conjunction with any of the other location indicating output means described herein.

In an example described herein, the system may be used in an aircraft and the means for providing an indication of the location of the detected thermal event may comprise the individual audio visual entertainment systems that are provided in the backs of the seats or at the bulkhead, or overhead.

The systems described herein may be used in an aircraft, the system being integrated with an existing lighting/audio visual entertainment system, and/or speaker system of the aircraft. The systems may also be used in any other area that may require fire or overheat detection, such as a building, ship, train etc. The systems can also be integrated into the existing systems of these.

The examples described herein may further be used in combination with each other, so that the means for indicating the location may comprises any combination of the different location indicating output means described herein.

Any type of sensor that is capable of detecting a thermal event may be used. In some examples, the plurality of sensors may be fibre optical thermal sensors, such as distributed sensors, including Rayleigh, Raman or Brillouin sensors, or Quasi distributed sensors such as Fibre Bragg Grating sensors. Such sensors may detect smoke, fire, heat, flame, and/or carbon monoxide.

In an example described herein, the system may further comprise a graphical user interface that provides a graphical illustration of the location of the thermal event. The graphical user interface may further comprise means for receiving a user input. The means for receiving the user input may comprise a touch screen display for displaying images and receiving user input in response to a user touching the touch screen display. The means for receiving the user input may further comprise means for receiving a request to perform a zoom operation at a focal point of a target element on the graphical user interface. The graphical user interface may further be adapted to illustrate the positions of the sensors and may also be adapted to illustrate the location of the detected thermal event with respect to the sensors.

The systems described herein will now be described with reference to the drawings.

DETAILED DESCRIPTION

The term 'thermal event' as described herein refers to any increase in temperature. Such increases in temperature may, for example, result in smoke, fire, heat, flame, and/or the release of carbon monoxide, or other chemical, such as those produced when an aircraft wiring harness or electrical system overheats or catches fire.

Figure 1:
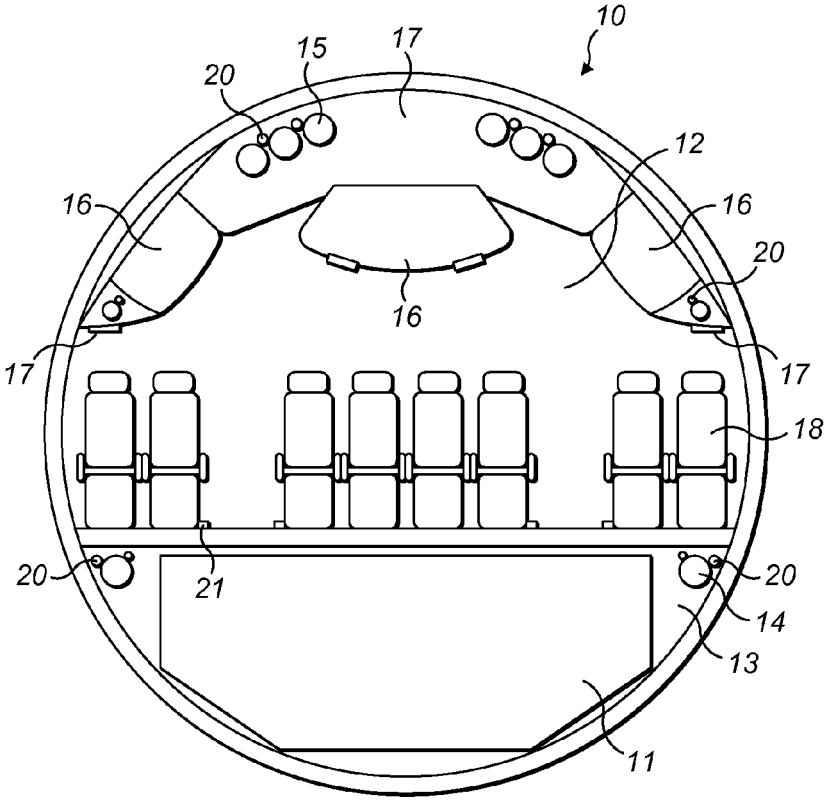
FIG. 1 depicts a cross-sectional view of an aircraft, showing an example of the sensing means that may be used in the systems described herein.

A cross-sectional view of an aircraft, or aeroplane, 10, within which the systems described herein can be used, is shown in FIG. 1. As can be seen in the figure, a typical aircraft, 10, may comprise seats, 18, as well as features such as stowage bins, 16, and passenger service unit modules, 17, such as those described in U.S. Pat. No. 6,393,343 B1. Such passenger service unit modules, 17, may be connected through data buses to an aircraft cabin central control for controlling and monitoring cabin lighting systems, a captain public address system, displays, keyboards, temperature sensors and air circulation sensors, timers, counters, switches etc.

The aircraft may also comprise a cargo compartment, 11, and an aircraft cabin, 12. The aircraft cabin, 12, may further comprise emergency floor lighting, 21, to direct the passengers to the emergency exits in the event of an emergency.

Many areas in an aircraft are unprotected by fire detection and suppression systems and rely on passengers and crew to identify smoke by sight, smell or sound, followed by the use of hand extinguishers to suppress the fire. The development of an odour, or smoke can take some time, however, before it can be detected. This is particularly dangerous if the fire or overheat event is in a hidden area in an aircraft.

As can be seen in FIG. 1, for example, a cheek area, 13, is provided underneath the aircraft cabin, 12, and typically contains wire bundles, hydraulic lines and other electrical components, 14. The over head area within the aircraft cabin, 12, also comprises a crown space, 17, which typically contains components of the aircraft's entertainment system, wire bundles, control cables, air-conditioning systems, passenger emergency oxygen system and other systems, 15. These areas containing electrical components may therefore be susceptible to fires, and since the location of the fire would be hidden behind a panel, difficult to locate and also access in order to fight them. The consequence of such a delay may be that the fire becomes non-survivable before the aircraft has an opportunity to land. Such fires are normally extinguished by the application of suppressant from a hand-held extinguisher.

Although temperature sensing systems have previously been described for use in an aircraft, such systems do not provide an accurate or user-friendly means of indicating the exact location of a thermal event such as a fire or overheat event.

The thermal event detection and notification systems described herein are not only able to detect the location of a thermal event such as a fire or overheat event, but are also able to physically alert and direct a person to the exact location of the thermal event. This is achieved due to the fact that the system is configured to provide an indication of the location of the detected thermal event, at its actual location.

More specifically, the systems described herein have sensing means, (described later) which may be distributed within an area, such as in an aircraft, building, ship or train, etc. These sensing means are configured to sense and detect a thermal event at a plurality of locations within the aircraft, or building etc. The system also may have means for providing an indication of the location of this detected thermal event, and this indication means may comprise a plurality of location indicating output means which are also distributed at a plurality of locations within the area. The control unit may also comprise means for determining which of the plurality of these location indicating output means is or are located closest to the detected thermal event location. The output means are then controlled so that the output or outputs produced by the output means that is or are closest to the location of the detected thermal event are not the same as the outputs produced elsewhere. In this way, the indication of the location of the thermal event is provided at the actual location of the thermal event.

Due to this, the people dealing with the thermal event in order to bring it under control can be alerted to and directed straight to the location that needs attention, thereby reducing further damage to the aircraft or building etc and/or reducing the possibility of injury to the people within the aircraft or building etc.

In at least some of the examples described herein, the system may be integrated with, or communicate with, the intelligent, addressable lighting, audio or entertainment systems that are standard in contemporary aircraft. The system may also be integrated into the existing systems of a building, ship, train, or any other area that may require a thermal event detection and notification system.

For example, the indicating means may comprise the existing cabin light system of an aircraft, and the location indicating output means are therefore the plurality of individual cabin lights that are distributed at a plurality of locations within the aircraft cabin, the output being light. In this example, the system may be configured to cause those emergency exit floor lights, 21, service call lights, or reading lamps that are closest to the detected fire or overheat event switch on, or to flash and/or change in colour, whilst the remaining lights within the aircraft cabin react differently.

In some examples described herein, which may also be used in combination with any of the other location indicating output means described herein, the plurality of lights may be configured such that the light or lights that are closest to the detected thermal event appear visually different to those that are not closest to the detected thermal event.

For example, the lights may be configured, in response to instructions from the control unit, to provide a first level of illumination at the location at which the thermal event has been detected, and for the lights that are not in this location to conversely provide a second, different level of illumination. For example, the light or lights closest to the location of the detected thermal event may be lit while the others are not, and vice versa. The lights may alternatively be dimmed at different levels. This thereby provides a visual indication of the thermal event at the actual location of the thermal event.

In another example, which may also be used in combination with any of the other location indicating output means described herein, the plurality of lights may be capable of being illuminated in a plurality of colours and may further be configured, in response to instructions from the control means, to be illuminated in a first colour at the determined thermal event location, and a second, different colour, at a second location that is different to the location of the thermal event. This thereby also provides a visual indication of the thermal event at the actual location of the thermal event. For example, the light, or lights that are positioned closest to the detected thermal event may be lit up as red, whereas the remaining lights that are not close to the detected thermal event may turn green, or some other colour, or may remain switched off completely. Alternatively, the lights at the detected thermal event location may be lit up red, (or some other colour), whilst the remaining lights are illuminated as normal, without changing colour.

In a further example, which again may also be used in combination with any of the other location indicating means described herein, the plurality of lights are configured, in response to instructions received from the control means, to flash at a first rate at the location of the thermal event, and at a second different rate at a location that is different to this. Alternatively, the lights may flash at the location of the thermal event and not in the other location, or vice versa.

In a further example, when the system is used in an aircraft, the location of the event may be indicated to the flight attendants or passengers via an illuminated indicator, or light, that has been specifically positioned in the aircraft for this purpose. For example, a plurality of additional lights could be provided on the cabin wall and could be illuminated to indicate the location of a detected thermal event that is found in the cheek area, 13, of an aircraft, 10.

These systems are therefore able to provide visual indications, at the actual location of the thermal event, even if the fire or overheat is hidden behind a panel.

In another example, the means for providing an indication of the location of the thermal event may comprise an audio visual entertainment system. When used in an aircraft, the plurality of location indicating output means may therefore comprise the plurality of individual audio visual systems that are already provided in aircraft, in the form of seat back or overhead entertainment systems (not shown in the figures). In such a situation, the entertainment system located closest to the detected thermal event may provide a signal such as a message upon the screen and/or an audio message, thereby indicating that the detected thermal event is located in the vicinity. The message may provide further information regarding the exact location of the detected event.

In another example, the indication of the location of the thermal event may comprise an audible indication, and when used in an aircraft, this may be transmitted through one or more of the speakers that is or are positioned closest to, or adjacent to, the detected thermal event. Such speakers are provided as standard in aircraft and are normally used for passenger announcements etc. The audible indication, or signal, may be a loud noise, like an alarm, or alternatively, may be a specific message informing the person or people in that location that there is a fire in the immediate vicinity. In this example, the plurality of speakers are therefore configured such that the speaker or speakers closest to the detected thermal event provide a different audio output to those that are not closest to the detected thermal event.

Figure 2:
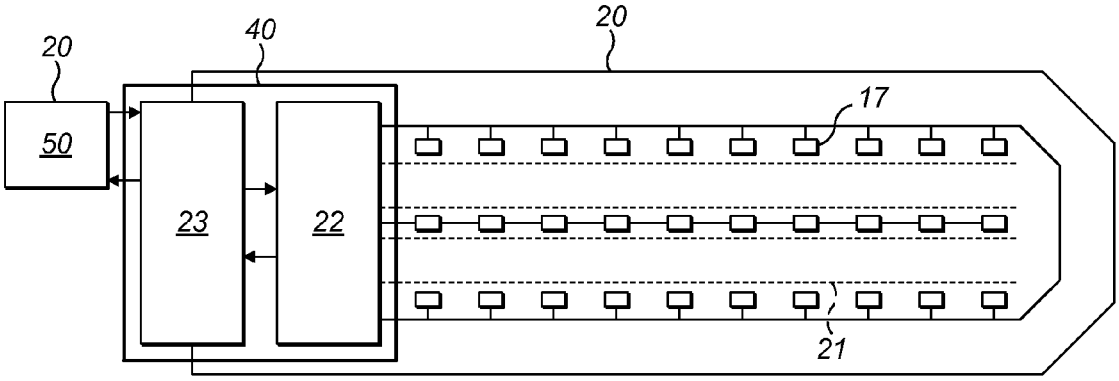
FIG. 2 depicts an example of a system as described herein.

The thermal event detection and notification systems described herein further comprise sensing means, 20, as shown in FIG. 2. Any type of sensing means that is capable of detecting a thermal event may be used. In some examples, however, the sensing means may comprise a fibre optical thermal sensor, such as distributed sensors, 20, i.e. Rayleigh, Raman or Brillouin sensors, or Quasi distributed sensors such as Fibre Bragg Grating sensors. Such sensors may detect smoke, fire, heat, flame, and/or carbon monoxide.

The sensing means, 20, may be positioned or distributed within the aircraft so that it is capable of detecting a fire or overheat in a plurality of locations within the aircraft. For example, the sensing means may comprise an optical fibre cable that may extend along the length, or around the perimeter of the aircraft cabin or cheek area of the aircraft. The sensing means may alternatively, or additionally, comprises a plurality of discrete sensors that are provided at different locations in the aircraft.

In one example, the sensing means, 20, may be positioned within the cheek area, 13, of the aircraft, 10, and may further be positioned adjacent to, or at least near to, the electrical aircraft system components, 14, see FIG. 1. The sensing means may also, or alternatively, be positioned in the aircraft cabin, 12, and may further be positioned adjacent to, or at least near to, the electrical aircraft system components, 15, located there. The sensing means may also be positioned in other regions of the aircraft, such as the cockpit, 50, or other regions that may remain hidden from view in normal situations, or that may even be visible.

An example of a system is shown in FIG. 2. This shows a simplified schematic view of an aircraft from above, depicting, in particular, some of the features of the systems described herein.

As shown in FIG. 2, a control unit, 40, is in communication with the sensing means, 20, as well as the location indicating means, 17, 21. In this example the sensing means, 20, is able to provide thermal event detection at a plurality of locations around the entire circumference and length of the aircraft cabin, 12, and/or corresponding cheek area, 13, however, the sensing means can be positioned or distributed anywhere within the aircraft. For example, the system of FIG. 2 also comprises sensing means, 20, in the cockpit, 50, however, this is also down to choice of location and not necessary. In this example shown in FIG. 2, the location indicating means comprises at least the emergency exit lights, 21, and/or the light(s) and/speaker(s) in the passenger service units, 17.

The control unit comprises means, 23, for receiving information from the sensing means, 20, the information being indicative of the thermal event. In other words, when the sensing means detects a thermal event somewhere in the aircraft, information is communicated back to the control unit to confirm this. The control unit, 40, may further comprise means to determine, based on this information received from the sensing means, the exact location of the thermal event within the aircraft.

As can be seen in FIG. 2, the control unit, 40, may further comprise location indicating control means, 22, which is in communication with the location indicating means, described above. The location indicating control means, 22, then uses this information regarding the location of the detected thermal event, to control the plurality of location indicating output means, e.g. lights etc, within the aircraft in such a way that those location indicating output means that is or are closest to the detected thermal event react differently to those that are not closest to the thermal event (as described above).

This communication between the location indicating control means, 22, and the plurality of location indicating output means, 17, 21, may be achieved via the data bus, as described above, or alternatively, may be wireless.

In use, the control unit, 40, therefore receives information from the sensing means, 20, that a thermal event has been detected and based on that information, determines the location of the detected thermal event. Based on this information regarding the location of the thermal event, the location indicating control means, 22, of the control unit, 40, then communicates with the location indicating means, 17, 21, and controls the functions of the plurality of location indicating output means, (such as emergency exit lights and/or the lights and/or speakers of the passenger service units), so that those closest to the location of the thermal event are activated or modulated in a way that differs to those not closest to the thermal event so that the output means that are closest to the detected thermal event do not produce the same output as those that are not closest to the detected thermal event. This thereby indicates, at the actual location of the detected thermal event, the location of the thermal event.

In a further example, a graphical user interface (GUI) may additionally be used with the systems described herein, that indicates the location of a fire/overheat event on a schematic of the aircraft, from the distributed sensor spatial data. This would allow the flight attendants to visually identify the location of the overheat or fire event, and thereby react accordingly. The plan may also be zoomed by the use of a touch screen or other input device to show the location of the event in greater detail. Information from other thermal/smoke sensors could obviously be shown on the same display.

As described above, the systems described herein provide significant advantages over known thermal event detection and notification systems in that the system is able to quickly direct cabin crew to the location of even a hidden fire/overheat event and thereby allow hand extinguishers to be deployed more effectively. In situations where the thermal event is hidden and no smoke or flames etc can therefore be seen or heard by a person, this system thereby provides invaluable visual an/or audible information to the person that is to deal with the fire or overheat event.

This is also advantageous as the system may provide a visual or audible indication of where to power down non-critical systems.

The use of a system as described herein wherein it is integrated with the existing lighting, speaker, and/or entertainment systems of an aircraft would also save weight over a discrete system.

The invention claimed is:

1. A thermal event detection and notification system for an aircraft comprising a sensor for detecting a thermal event, a control unit comprising a display for receiving information from the sensor the information being indicative of the detected thermal event, wherein the control unit determines, based on said information received, a location of said thermal event, and further comprising means responsive to information received from said control unit regarding said location, for providing an indication of the location of the detected thermal event to provide said indication of the thermal event location at said thermal event location, said indication of the location comprises a visual indication provided at floor lights of an aircraft, the floor lights indicate the location of the detected thermal event, wherein said means for providing an indication of the location comprises a plurality of lights, wherein said plurality of lights are configured, in response to said information received from said control unit, to provide illumination at said thermal event location and no illumination at a second location, different to said thermal event location, thereby providing said visual indication of said thermal event at said thermal event location;

wherein said sensor is distributed within an area and is configured to sense said detected thermal event at a plurality of locations within said area;

wherein said plurality of lights comprises a plurality of locations indicating output means distributed at a plurality of locations within said area; and wherein said control unit determines which of said plurality of location indicating output-means are located closest to said detected thermal event location and using said closest output means to provide said indication of the location of the detected thermal event; and wherein the notification system physically alerts and directs a person to the exact location of the thermal event within the aircraft.

2. The system of claim 1, wherein said plurality of lights are configured, in response to the control unit, to flash at a first rate at said thermal event location, and to not flash at said first rate at a second location, different to said thermal event location, thereby providing said visual indication of said thermal event at said thermal event location.

3. The system of claim 1, wherein said plurality of lights are configured, in response to the control unit, to flash at a first rate at a second location, different to said thermal event location, and to not flash at said first rate at said thermal event location, thereby providing said visual indication of said thermal event at said thermal event location.

4. The system of claim 1, wherein said indication of the location of the thermal event further comprises an audible indication provided at said thermal event location.

5. The system of claim 1, wherein said means for providing an indication of said detected thermal event location comprises an audio visual entertainment system.

6. The system of claim 1, wherein the display further comprises a graphical user interface that provides a graphical illustration of the location of the thermal event.

7. The system of claim 6, wherein the graphical user interface receives a user input.

8. The system of claim 7, wherein the display is a touch screen display for displaying images and receiving user input in response to a user touching the touch screen display.

9. The system of claim 7, wherein the display comprises means for receiving a request to perform a zoom operation at a focal point of a target element on said graphical user interface.

* * * * *